US005345789A

United States Patent [19]

Yabuta

[11] Patent Number: 5,345,789

[45] Date of Patent: Sep. 13, 1994

[54] APPARATUS FOR CONTROLLING DISPLACEMENT OF YARN FEEDERS

[75] Inventor: Masahiro Yabuta, Wakayama, Japan

[73] Assignee: Shima Seiki Mfg., Ltd., Wakayama, Japan

[21] Appl. No.: 910,915

[22] Filed: Jul. 9, 1992

[30] Foreign Application Priority Data

Jul. 11, 1991 [JP] Japan ..... 3-198578

[51] Int. Cl.[5] ..... D04B 15/52

[52] U.S. Cl. ..... 66/126 A

[58] Field of Search ..... 66/126 R, 126 A, 127, 66/125 R, 128, 129, 131, 133, 138, 139

[56] References Cited

U.S. PATENT DOCUMENTS 4,052,865 10/1977 Zamarco ..... 66/127 X
4,354,363 10/1982 Inoue ..... 66/128
4,658,603 4/1987 Stoll et al. ..... 66/126 R
4,738,124 4/1988 Stoll et al. ..... 66/127
5,031,423 7/1991 Ikenaga ..... 66/126 R
5,109,681 5/1992 Schmid et al. ..... 66/126 R

FOREIGN PATENT DOCUMENTS 50-13657 2/1975 Japan .
2137234 10/1984 United Kingdom ..... 66/126 A

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

There are disclosed improvements in flat knitting machines incorporating a plurality of carriages which respectively adjust the forward and backward movement of knitting needles mounted on respective needle beds, a pair of yarn guide rails which are respectively secured above and in the longitudinal direction of respective needle beds, and a plurality of yarn feeders which respectively feed yarns to knitting needles in association with those yarn guide rails while the carriages run themselves. The improvements comprise novel apparatus for arranging the yarn feeding apertures of the yarn feeders by lowering same to a predetermined position while controlling the shifting movement and stopping operation of the yarn feeders.

1 Claim, 4 Drawing Sheets

APPARATUS FOR CONTROLLING DISPLACEMENT OF YARN FEEDERS

BACKGROUND OF THE INVENTION

The present invention relates to an apparatus for driving controlling displacement of a plurality of yarn feeders arranged in a flat knitting machine.

Reflecting widely diversified fashions of garments in recent years, those modern knits including sweaters knitted by operating flat knitting machines contain a variety of color yarns and various kinds of yarns.

Any of those conventional flat knitting machines available for knitting color yarns of various kinds are furnished with a plurality of carriages which are secured to needle beds in order to adjust movement of knitting needles into and out of a knitting zone. In addition, a plurality of yarn feeders are slidably installed in the front and on the back of a plurality of yarn-guide rails which are secured above and in the longitudinal direction of those needle beds. In this case, it is necessary for respective yarn feeding apertures at the bottom tips of those yarn feeders to properly feed yarns at predetermined positions close to the tips of knitting needles when those knitting needles on the needle bed project themselves at the knitting position.

However, when setting all the yarn feeding apertures of those yarn feeders at predetermined positions close to the tips of knitting needles while knitting needles project themselves at the knitting position, those yarn feeding apertures collide with each other on the way of shifting positions of those yarn feeders which presents a critical problem to solve.

Now, therefore, in order to solve this problem, the applicant of the present invention previously proposed prior art related to a knitting yarn feeding system as disclosed in the Japanese Laid-Open Patent Publication No. 50-13657 of 1975. The disclosed prior art features the structure described below.

A plurality of carriages for adjusting positions of knitting needles into and out of a knitting zone are installed on a plurality of yarn guide rails disposed above and in the longitudinal direction of needle beds. An operating pin is also provided, which is capable of controllably moving itself in the vertical direction from those carriages to the yarn feeders.

A coupling recess available for engagement with the operating pin is provided on the top surface of each yarn feeder. Concretely, when the operating pin which is engaged with the coupling .recess moves in association with yarn feeders, the operating pin forcibly opens a link in resistance against attractive energizing force of a spring in order to lower yarn feeding apertures on the bottom tip of respective yarn feeders down to a predetermined position close to the tips of the knitting needles. On the other hand, when the operating pin engaged with the coupling recess is not accompanied with yarn feeders, the operating pin attracts the link by an attractive energizing force of a spring to lift the yarn feeding apertures at the bottom tips of respective yarn feeders, thus preventing yarn feeding apertures of other remaining yarn feeders from interferring with each other.

Nevertheless, since the preceding prior art disclosed in the above-cited Japanese Laid-Open Patent Publication No. 50-13657 of 1975 is structured to shift yarn feeders by forcibly opening a link composed of two pairs of levers and pins in resistance against tensile force of a spring on the way of shifting an engaged rod available for shifting a yarn guide unit, when the spring exerts such tensile force stronger than a sliding resistance generated by yarn feeders, those yarn feeders are transferred in such a state in which the link is not fully spread, in other words, in such a state in which yarn feeding apertures are not fully down.

Furthermore, since the tensile force of the spring is exerted in the direction of proceeding yarn feeders, even when the engaged rod available for shifting a yarn guide unit halts at the predetermined position, due to effect of a tensile force generated by the spring, yarn feeders are obliged to travel themselves furthermore, thus making it difficult for the flat knitting machine to correctly control the shifting movement and stopping operation of the yarn feeders.

OBJECT AND SUMMARY OF THE INVENTION

Therefore, the invention has been achieved to fully solve those technical problems described above. The object of the invention is to provide a novel apparatus which is capable of precisely arranging all the yarn feeding apertures of yarn feeders by way of fully lowering them down to the predetermined position, and at the same time, precisely controlling the shifting movement and stopping operation of the yarn feeders.

To achieve the above object, the apparatus for driving yarn feeders built in the flat knitting machine related to the invention features the structure described below.

Basically, the flat knitting machine available for embodying the invention incorporates a plurality of carriages which respectively adjust the movement of knitting needles mounted on respective needle beds, a pair of yarn guide rails which are respectively secured above and in the longitudinal direction of respective needle beds, and a plurality of yarn feeders which respectively feed yarn to knitting needles in association with those yarn guide rails while the carriages operate themselves.

In order to embody the invention, the flat knitting machine is furnished with the following; a plurality of yarn feeders which are respectively disposed in the front and on the back of a yarn guide rail; a means for selecting specific yarn feeders to have them operate in association with each other; and a means for lowering yarn feeding apertures of respective yarn feeders to be very close to the tips of the knitting needles; wherein these two means are respectively installed between those carriages and yarn feeders. More particularly, the above-identified yarn feeder selecting and carrying means has a carrying pin capable of moving itself in the forward and backward directions from specific carriages respectively facing a yarn feeder and a coupling recess for allowing the carrying pin to be engaged with a predetermined domain of the yarn feeder facing the carriages. On the other hand, the above-identified lowering means energizes a feeder rod in the upward direction by means of a spring, and then, when causing the carrying pin to move itself in company with a selected yarn feeder, the lowering means simultaneously lowers the tip of the feeder rod in resistance against an upwardly energized force from the spring.

Next, functional operation of the apparatus embodied by the invention is described below.

First, a plurality of carriages are activated to operate themselves on the top surface of corresponding needle beds. Next, when adjusting the movement of knitting needles in the movement directions, the above-identified lowering means starts to operate itself in association with the above-identified yarn feeder selecting and carrying means. As a result of the activated operation of the yarn feeder selecting and carrying means, selected yarn feeders respectively adjust the movement of knitting needles in the proper directions by way of being accompanied with the carriages. Simultaneously, the lowering means lowers yarn feeding apertures down to a predetermined position very close to the tips of knitting needles, and then securely feeds the yarn to knitting needles mounted on respective needle beds.

Next, as soon as those carriages arrive at the predetermined position to stop the movement of yarn feeders, the yarn feeder selecting and carrying means and the lowering means are respectively freed from their operating condition. As a result, carriages are also released from the state of being accompanied by those yarn feeders before these carriages are brought to a full stop.

Simultaneous with the release of the lowering means from an operating condition, yarn feeding apertures of respective yarn feeders ascend themselves. In consequence, even when those yarn feeding apertures of other remaining yarn feeders individually pass by themselves, unwanted interference between those yarn feeding apertures at the bottom ends of respective yarn feeders can securely be prevented from occuring.

DETAILED DESCRIPTION OF THE PREFERRED EMBODIMENTS

Referring now to the accompanying drawings, detail of the apparatus for driving yarn feeders built in a flat knitting machine is described below.

Figure 1:
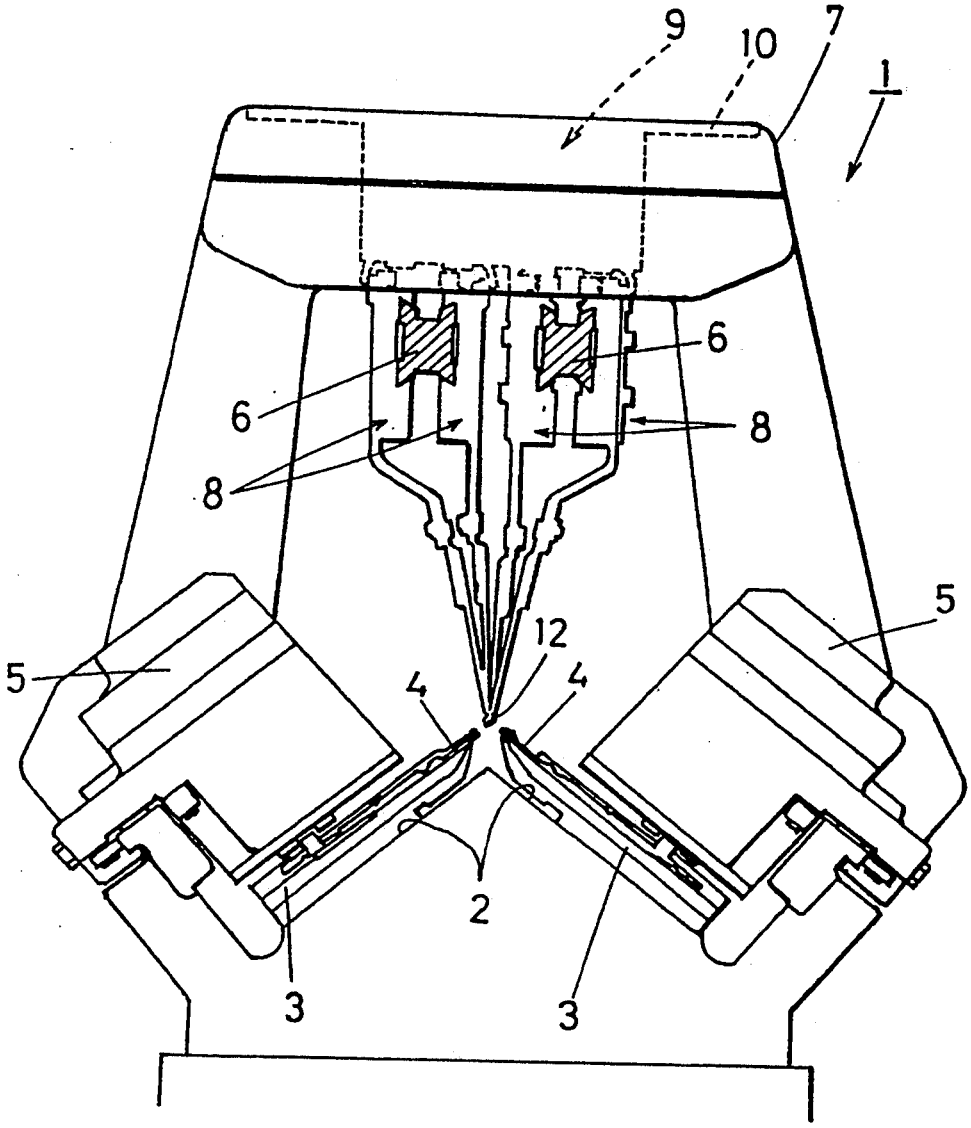
FIG. 1 is a lateral view of carriages built in the flat knitting machine related to the invention.

FIG. 1 illustrates a lateral view of the flat knitting machine designated by the reference numeral 1 in the accompanying drawings.

Basically, the flat knitting machine 1 incorporates a pair of needle beds 3 and 3 on the top surface of a body bed 2 by way of a reverse-V shaped formation as viewed from a lateral side. Each needle bed 3 incorporates a plurality of knitting needles 4 to permit all the knitting needles 4 to move themselves in the forward and backward directions as required. A pair of carriages 5 and 5 are mounted on the top surface of those needle beds 3 and 3, these carriages 5 and 5 are slidably movable by a drive unit (not shown) in order to shift the position of the knitting needles back and forth. These carriages 5 and 5 are linked with each other by means of a gate-shaped connecting frame 7 formed by way of spanning yarn guide rails 6 which are disposed in the longitudinal direction of a pair of needle beds 3 and above the tip ends of those needle beds 3, thus enabling those carriages 5 to jointly and simultaneously operate themselves.

Figure 2:
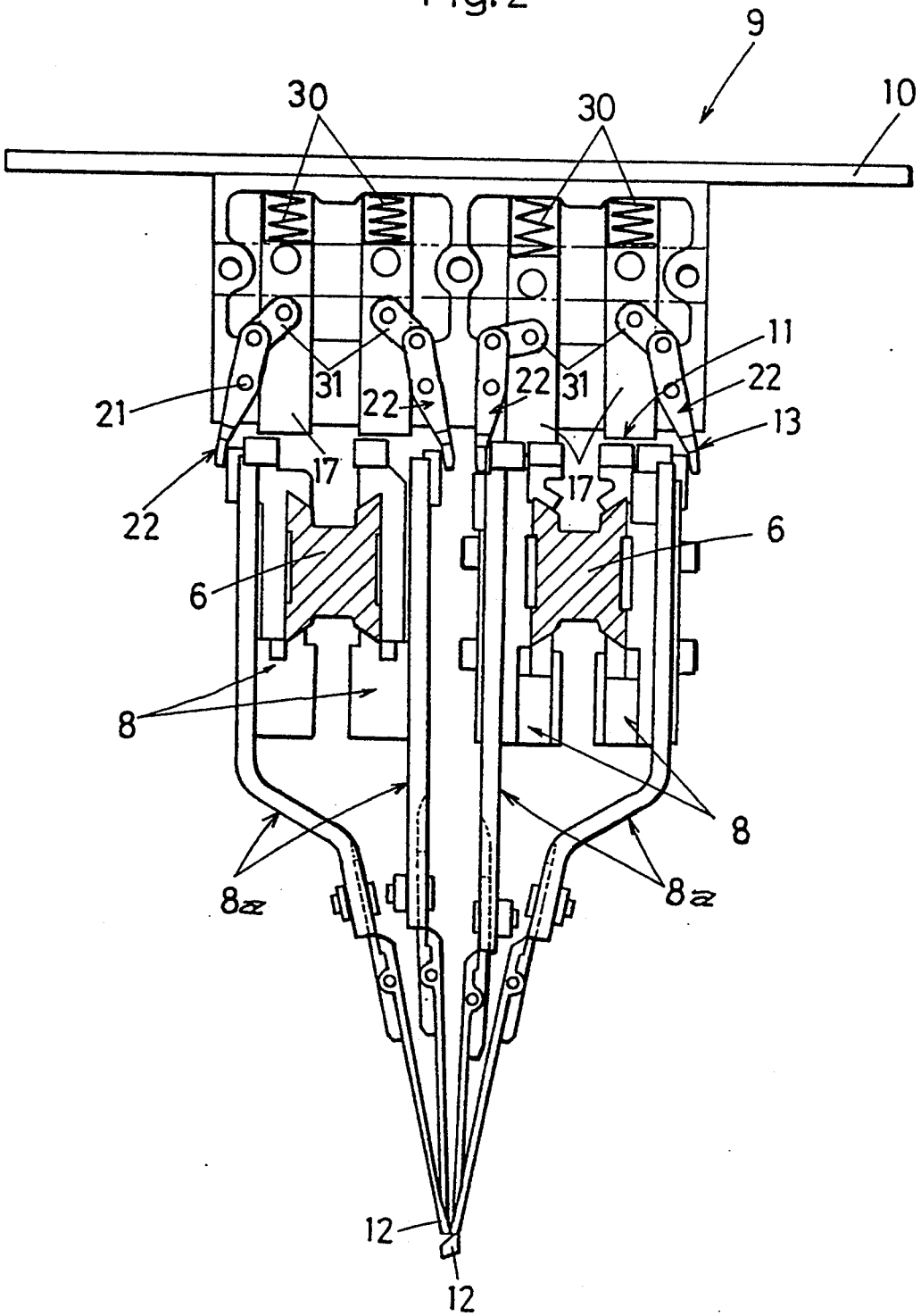
FIG. 2 is a schematic front view of the apparatus for driving yarn feeders embodied by the invention.

As shown in FIGS. 1 and 2, sections off the yarn guide rails 6 are formed in approximately a H-shape. Each yarn feeder 8 is slidably set to the front and back surfaces of each yarn guide rail 6. Each yarn feeder 8 is selected by a drive unit 9 secured in the center of the gate-shaped connecting frame 7 before being driven by the drive unit 9.

Figure 3:
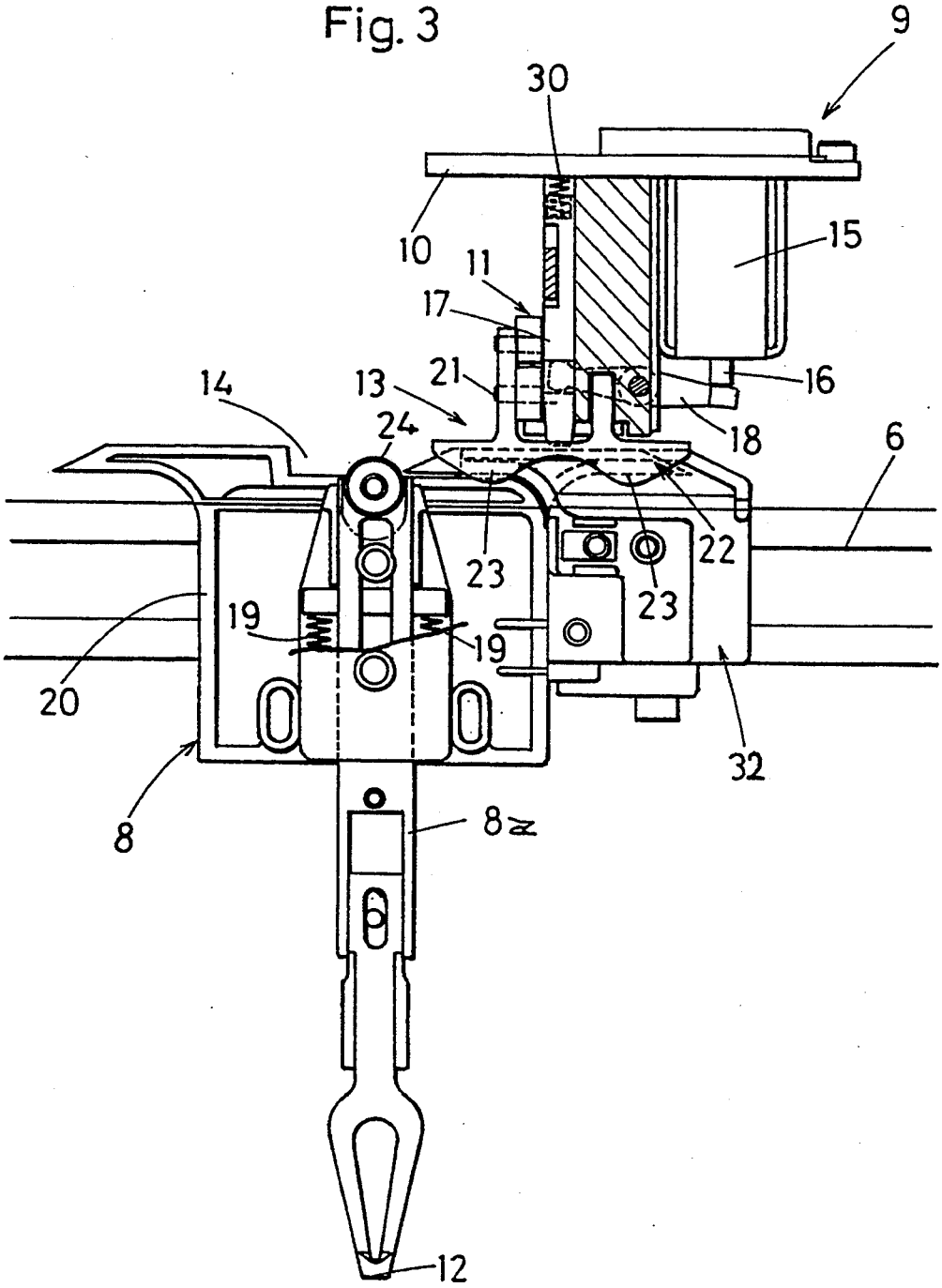
FIG. 3 is a schematic lateral view of the apparatus for driving yarn feeders embodied by the invention.

As shown in FIGS. 2 and 3, the drive unit 9 available for driving a plurality of yarn feeders 8 is installed on the bottom surface of a base plate 10 secured to the gate-shaped connecting frame 7. Characteristically, the drive unit 9 comprises a carrying means 11 and a lowering means 13 available for lowering each yarn feeding aperture 12 at the bottom tip of each yarn feeder 8, down to a predetermined position close to the tips of the knitting needles 4 being opposite from those yarn feeders 8 on the yarn guide rails 6.

Structurally, the above-identified yarn feeder carrying means 11 comprises a coupling recess 14 which is provided in the upper end and the center portion of each yarn feeder 8, a bistable solenoid 15 which is activated into operation by an operating signal from a control unit (not shown), and an output force transmission rod 18 which transmits the moving force of an output shaft 16 of the bistable solenoid 15 to a carrying pin 17. On the other hand, the above-identified lowering means 13 features the structure described below.

A feeder rod **8*a* is secured by means of a feeder case 20 onto the center domain of the recess 14 formed in the center domain of the top end of each yarn feeder 8. The feeder rod 8*a* is secured to the feeder case 20 in such a state in which the intermediate height position is upwardly energized by a push-up spring 19. Each yarn feeding aperture 12 is formed at the bottom end of the feeder rod 8*a*. An end of a connecting plate 31 is connected to the intermediate height position of the carrying pin 17, whereas the other end of this connecting plate 31 is connected to the top end of a cam plate 22 (which is to be described later on) which presses the feeder rod 8*a* downward. By virtue of the arrangement of those components described above, the cam plate 22 swings itself back and forth by way of pivoting on a swing-movement supporting pin 21 in relation to the vertical movement of the carrying pin 17. As shown in FIG. 3, the bottom-end domain of the cam plate 22 is substantially of a "twin-hill" cam shape which accommodates a pair of cams 23 available for pressing down a slide roller 24 at the tip end of the feeder rod 8*a* at such intervals substantially being equal to the width of the coupling recess 14**.

Next, operation of the drive unit 9 available for driving yarn feeders 8 is described below.

First, drive signal output from a control unit (not shown) activates operation of a carriage drive unit to move the carriages 5 on the upper surface of needle beds 3. As a result, these carriages 5 are permitted to properly adjust forward and backward movement of those knitting needles 4 mounted on respective needle beds 3.

While these carriages 5 still keep on operating, a bistable solenoid 15 is activated by a control signal available for pattern knitting in such a region where no knit is composed. Then, as shown in FIG. 3, output shaft 16 of the bistable solenoid 15 enters into a set position in such a state in which the output shaft 16 projects itself in the downward direction. Simultaneously, the carrying pin 17 of the above-identified yarn feeder carrying means 11 ascends itself via the above-identified moving force transmission rod 18 in resistance against the tensile force of a push-down spring 30, operative above carrying pin 17. When the carrying pin 17 ascends higher, the cam plate 22 of the above-identified lowering means 13 is already pushed upward by way of pivoting on a swing-movement supporting pin 21.

When the designated carriages 5 arrive at the position of the predetermined yarn feeders 8 which respectively feed yarns to knitting needles 4, the control unit (not shown) detects this effect and then outputs a control signal to feed power to the bistable solenoid 15. This in turn puts the output shaft 16 of the bistable solenoid 15 into a "reset" position simultaneous with the retraction of the output shaft 16 in the upward direction. As a result, the lifted carrying pin 17 is pressed downward by tensile force generated by the push-down spring 30. Simultaneously, in association with a downward movement of the carrying pin 17, the cam plate 22 of the lowering means 13 swings itself in a vertical state by way of pivoting on the swing-movement supporting pin 21 via the connecting plate 31.

The descended carrying pin 17 then thrusts in the coupling recess 14 of the feeder case 20 and then the predetermined carriages 5 jointly keep on running themselves while this condition is present. Of a plurality of cams 23 of the cam plate 22, a cam 23 on the upstream side in the running direction of those carriages 5 pushes down a slide roller 24 on the top end of the feeder rod 8*a* until reaches the feeder rod a position close to the tips of the knitting needles 4.

Figure 4:
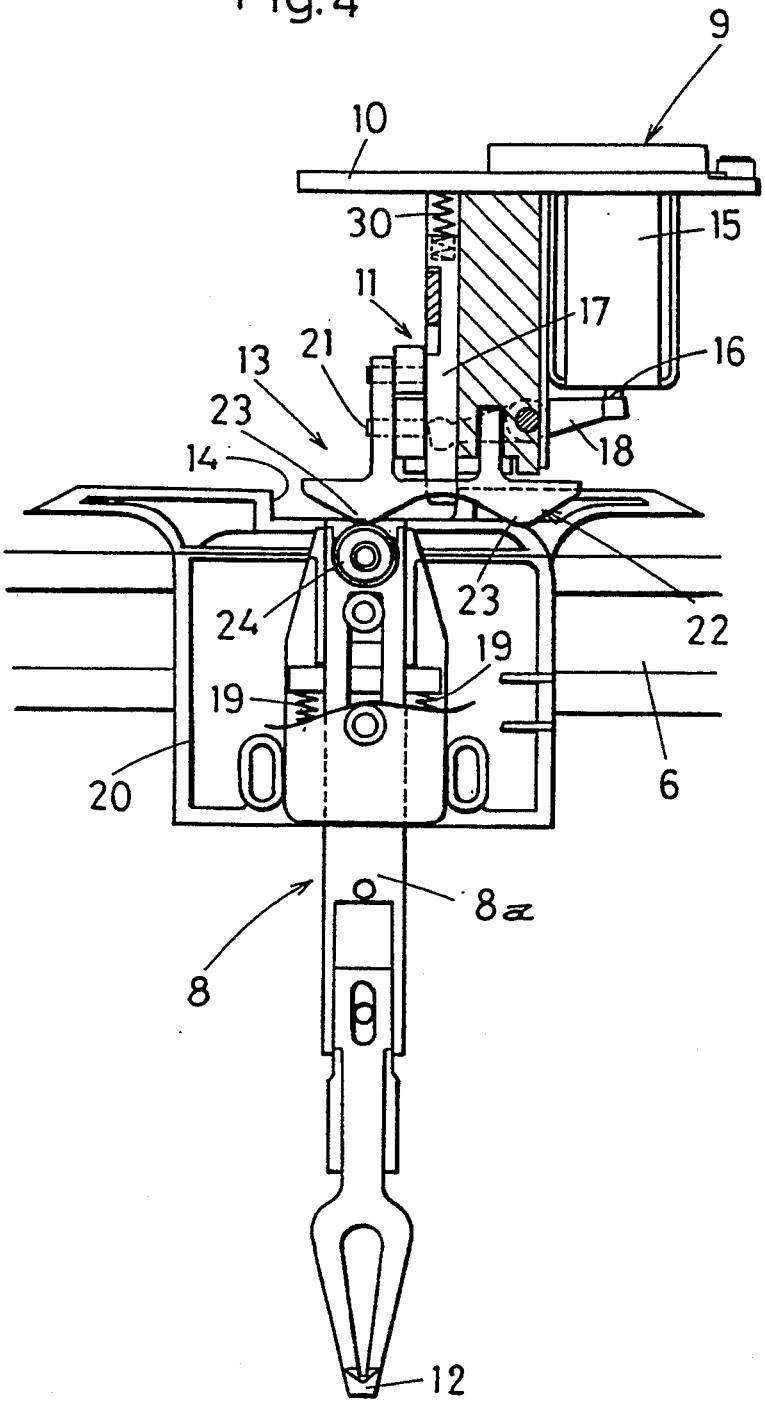
FIG. 4 is a schematic lateral view explanatory of operative condition of the apparatus for driving yarn feeders embodied by the invention.

Next, referring to FIG. 4, as soon as the lateral domain of the carrying pin 17 coupled with the coupling recess 14 of the feeding case 20 comes into contact with the lateral domain of the coupling recess 14, those predetermined yarn feeders 8 are drawn to the carriages 5, and then, desired knit (not shown) is eventually knitted up by those knitting yarn supplied to knitting needles 4 via the yarn feeding apertures 12.

Whenever those carriages 5 jointly stop the movement of those yarn feeders 8 or when those carriages 5 arrive at the predetermined position to activate movement of other yarn feeders 8, the control unit (not shown) detects this effect and then outputs a control signal to feed power to the bistable solenoid 15. Then, the descended carrying pin 17 is forcibly lifted in resistance against a tensile force generated by the push-down spring 30. Now that the carrying pin 17 ascends itself, the cam plate 22 of the lowering means 13 swings itself upward by way of pivoting on the swing-movement supporting pin 21.

As soon as the lifted carrying pin 17 is disengaged from the lateral domain of the coupling recess 14, movement of the corresponding yarn feeder 8 is discontinued. Simultaneously, by effect of swing movement of the cam plate 22 in the upward direction, the push-up spring 19 then pushes up the lowered feeder rod 8*a* until reaching a predetermined position at which the bottom-end yarn-feeding apertures 12 are perfectly free from incurring unwanted interference with each other.

Next, when the predetermined carriages 5 arrive at the predetermined position to activate operation of other remaining yarn feeders 8, the control unit (not shown) detects this effect and then outputs a control signal to shut off power from the bistable solenoid 15. As a result, the ascended carrying pin 17 is depressed by effect of a tensile force generated by the push-down spring 30, and simultaneously, the cam plate 22 of the lowering means 13 swings itself in the vertical direction by way of pivoting on the swing-movement supporting pin 21.

Next, the descended carrying pin 17 thrusts in the coupling recess 14 of the feeder case 20, and then, while this condition is present, when the carriages 5 respectively proceed themselves furthermore, the slide roller 24 on the top of the feeder rod 8*a* is pushed downward by the upstream-side cam 23 of the cam 22 in the running direction of the carriages 5. As a result, the bottom-end yarn feeding aperture 12 is pushed downward until reaching a predetermined position close to the tips of the knitting needles 4.

Thenceforth, using those knitting yarns supplied from the yarn feeding apertures 12 of respective yarn feeders 8 in accordance with the sequential steps thus far described, desired knits are eventually formed.

The reference numeral 32 shown in FIG. 3 designates a stopper which is secured to the yarn guide rail 6 at an outer position of a knit width. The top end of the yarn feeder 8 thrusts in the coupling recess 14, where the tip domain of the top end of each yarn feeder 8 is provided with an incline in order to prevent the carrying pin 17 and the coupling recess 14 from incurring unwanted damage otherwise caused by additional run of those carriages 5 when the stopper 31 stops the movement of respective yarn feeders 8.

The above embodiment of the invention merely refers to provision of a pair of yarn guide rails 6 as shown in FIGS. 1 through 4. However, it is of course possible for the embodiment of the invention to provide a single yarn guide rail or a minimum of three of them as well. Furthermore, it goes without saying that a plurality of yarn feeders can also be provided for each yarn guide rail.

Furthermore, the above embodiment merely provides a conventionally called "double-piece bed" flat knitting machine which disposes a tip portion of needle beds in a reverse-V shaped formation as shown in FIG. 1 for example. However, it should be understood that the scope of the invention is also applicable to a conventionally called "quadruple-piece bed" flat knitting machine which is furnished with a pair of the "double-piece bed" flat knitting machines in the upper and lower positions. Concretely, when embodying the invention relative to the "quadruple-piece bed" flat knitting machine, in order to provide a surpassing functional feature like the knitted hall garments (which are substantially tubular knits) for the objective knitting machine, normally, it is essential for the knitting machine to secure physical space in the knitting region close to the teeth portion of carriages in order to dispose a movable sinker capable of controlling cam plate or such space for accommodating a stitch presser drive unit needed for pressing meshes of a knit and such space needed for permitting rotation of the stitch presser. In consequence, a vacant area of a knit region close to the teeth portion of a carriage is narrowed, and yet, since it is much more difficult for any conventional quadruple-piece bed knitting machine to smoothly operate yarn feeders in limited space than the case of operating the double-piece bed type flat knitting machine, the arrangement of the teeth region of needle beds in a reverse-V shaped formation embodied by the invention is extremely useful to solve technical problems.

What is claimed is:

1. An apparatus for controlling displacement of a plurality of yarn feeders arranged in a flat knitting machine, said flat knitting machine comprises at least one carriage for adjusting movement of knitting needles of needle beds into and out of a knitting zone, yarn guide rails having a front side and a back side are disposed above and in a longitudinal direction of the needle beds, and yarn feeders that feed yarn to the knitting needles by being guided and accompanied by the yarn guide rails, said yarn feeders are slidably secured to a front side and a back side of said yarn guide rails, each said yarn feeder includes a yarn feeder rod, said yarn feeder rod is energized upwardly into a coupling recess formed at an upper end of each yarn feeder by a push-up spring (19), a carrying means for selecting one of the yarn feeders, a lowering means for lowering the selected yarn feeder down to a predetermined position close to tips of the knitting needles, the carrying means comprising:

a solenoid controlled by a control unit, said solenoid having an output shaft (16), a transmission rod (18) is operated by said output shaft, said transmission rod transmits a moving force of the output shaft of the solenoid to a carrying pin (17), said carrying pin moves into and out of the coupling recess depending on a position of said transmission rod, and the lowering means comprising:

a cam plate connected to the carrying pin including a pair of cams (23) for pushing said yarn feeder rod downwardly.

* * * * *